United States Patent [19]

Appleford

[11] Patent Number: 4,775,177

[45] Date of Patent: Oct. 4, 1988

[54] ANTI-THEFT DEVICE FOR VEHICLE LOCKS

[76] Inventor: Stephen R. A. Appleford, 25, Oakley Road, Bromley, Kent, England

[21] Appl. No.: 72,325

[22] Filed: Jul. 13, 1987

[30] Foreign Application Priority Data

Jul. 16, 1986 [GB] United Kingdom ..... 8617319
Aug. 22, 1986 [GB] United Kingdom ..... 8620525

[51] Int. Cl.[4] ..... E05C 21/02
[52] U.S. Cl. ..... 292/336.3; 292/347
[58] Field of Search ..... 292/346, 347, 336.3, 292/1, 216

[56] References Cited

U.S. PATENT DOCUMENTS

| | | | |
|---|---|---|---|
| 2,730,395 | 1/1956 | Rolando | 292/347 X |
| 2,853,332 | 9/1958 | Stutnik | 292/347 |
| 3,474,648 | 10/1969 | Trinca | 70/181 |
| 3,501,187 | 3/1970 | Saksa et al. | 292/342 X |
| 3,623,758 | 11/1971 | Trinca | 292/347 |
| 3,860,278 | 1/1975 | Dalia | 292/347 |
| 3,915,485 | 10/1975 | Richman et al. | 292/347 X |
| 4,098,529 | 7/1978 | Bingham | 292/347 X |
| 4,202,571 | 5/1980 | Nishikooni | 292/216 |
| 4,239,270 | 12/1980 | Bridges | 292/347 |

*Primary Examiner*—Richard E. Moore
*Attorney, Agent, or Firm*—Dowell & Dowell

[57] ABSTRACT

A vehicle sill knob device comprises an elongate body to be gripped by the fingers of a user, said elongate member having a bore therethrough to receive the stem of a locking member of a lock in which said locking member is movable between locked and unlocked conditions. The body has a recess extending into said body from the upper end and is capable of receiving the head of the locking member when the latter is in its locked position to prevent engagement of said head by a filament such as a wire or tape for lifting said body.

The exterior of said elongate body is free from protrusions engageable by a filament such as a wire or tape and is shaped such that the body cannot readily be gripped by a filament such as a wire or tape, the lower end of the body being shaped such that it engages the surface of the sill so as to leave no surface engageable by a filament or tool otherwise capable of lifting said body.

11 Claims, 2 Drawing Sheets

ANTI-THEFT DEVICE FOR VEHICLE LOCKS

BACKGROUND TO THE INVENTION

This invention relates to a vehicle window sill knob anti-theft device.

It is well known that many vehicles are stolen or broken into by the simple expedient of inserting a wire or piece of packing case tape through the space between the door frame and window, the wire or tape being forced around the usual rubber moulding into which the edge of the window is seated. The wire or tape is then looped around the locking member, commonly a knob, of the door lock and the lock actuated to an unlocked condition.

OBJECT OF THE INVENTION

The object of the invention is to provide a simple means to prevent the locking member being lifted thereby to prevent unauthorised entry.

SUMMARY OF THE INVENTION

According to the invention there is provided a vehicle window sill knob device comprising an elongate body having an exterior surface engageable by the fingers for lifting it but free from projections engageable by a filament or tool otherwise capable of lifting said elongate body and having a bottom surface the rim of which is engageable with the sill so as to leave no surface engageable by a filament or tool otherwise capable of lifting said elongate body.

Further according to the invention there is provided a vehicle sill knob device comprising as elongate body to be gripped by the fingers of a user, characterized in that said elongate member has a bore therethrough to receive the stem of a locking member of a lock in which said locking member is movable between locked and unlocked conditions, that said body has a recess extending into said body from the upper end and capable of receiving the head of the locking member when the latter is in its locked position to prevent engagement of said head by a filament such as a wire or tape for lifting said body, the exterior surface of said elongate body being free from protrusions engageable by a filament such as a wire or tape and being shaped such that the body cannot readily be gripped by a filament such as a wire or tape, the lower end of the body being shaped such that it engages the surface of the sill so as to leave no surface engageable by a filament or tool otherwise capable of lifting said body.

Preferably a compression spring is provided within the bore to ensure that the elongate body member is maintained in engagement with the door into which the locking member passes.

Still further according to the invention there is provided a vehicle window sill knob device comprising an elongate body having a head portion and a stem portion, the sides of said head portion being inclined from a larger cross-sectional area at the juncture of the head and the stem to a region of smaller cross-sectional area, a bottom surface of said head portion having a rim engageable with the sill so as to leave no surface engageable by a filament or tool otherwise capable of lifting said elongate body, said stem portion having a recess to attachably receive the actuating rod of a door lock, whereby in use said stem is slidable within a recess in the sill and said head is movable from a raised position where the door lock is unlocked to a lowered position in engagement with the sill where the door lock is locked, said inclined sides and said engagement preventing gripping engagement by means of a wire or tape otherwise capable of lifting said body.

Preferably the lower outermost edge of the head is provided with a lip extending axially which when the elongate member is in the lowermost position digs into the fabric of the door capping or into a deformable washer intermediate the capping and the head to give greater safety against unauthorized insertion of a wire beneath the head.

By ensuring that the knob is inaccessible when the locking member is pushed down it is not possible for a loop to be manipulated into a position by which the locking member can be raised. Neither is it possible for a screwdriver or other such tool to be inserted under the knob.

BRIEF DESCRIPTION OF DRAWINGS

The invention will now be described by way of example with reference to the accompanying drawings in which:

FIG. 9 is a top plan view of the anti-theft knob shown in FIG. 1 showing a portion of the body having a flattened surface.

DESCRIPTION OF PREFERRED EMBODIMENT

Figure 1:
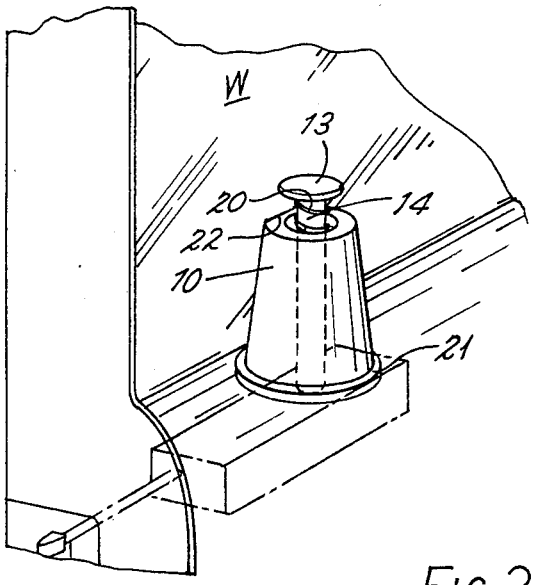
FIG. 1 is a perspective view of a portion of a vehicle door interior with the anti-theft knob device located on the sill locking member.
Figure 2:
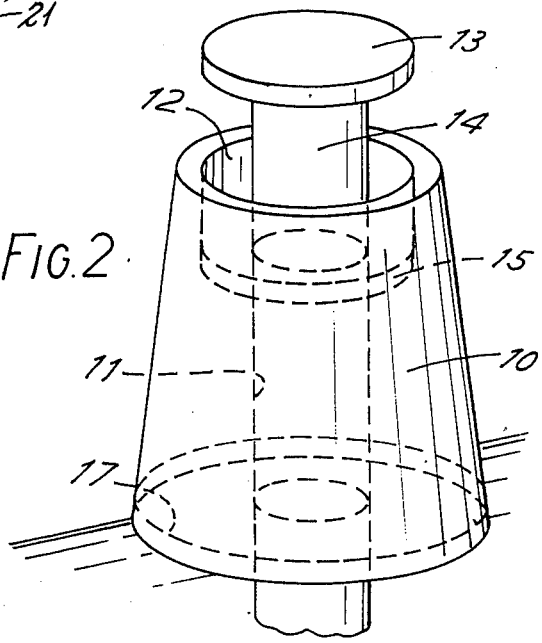
FIG. 2 is an enlarged perspective view of the anti-theft knob device and locking member.
Figure 3:
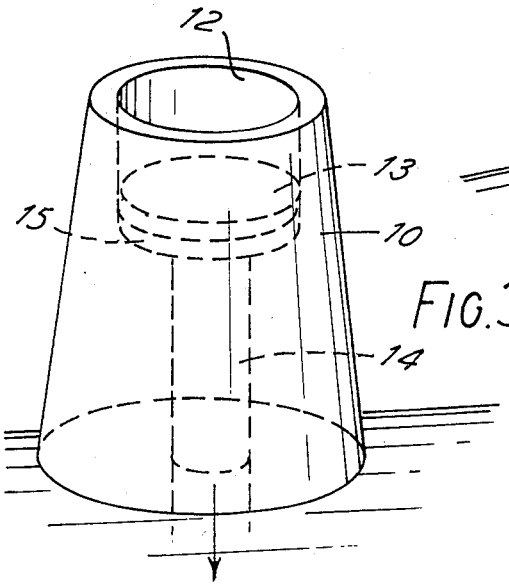
FIG. 3 is a perspective view of the anti-theft knob device with the locking member in its locked position.
Figure 4:
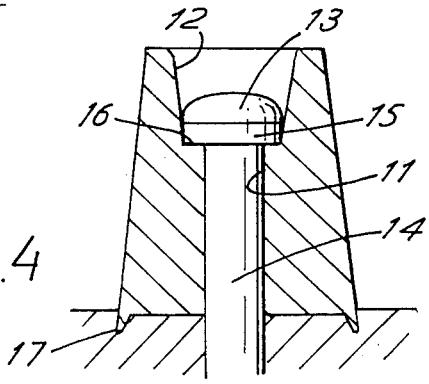
FIG. 4 is a longitudinal section through the anti-theft knob device with the locking member in the locked position.

The anti-theft knob device comprises a substantially frusto-conical body member 10 of suitably high density plastics material having a bore 11 therein to enable the stem 14 of a sill locking member of a lock mechanism (shown schematically in FIG. 1) to pass therethrough, said bore having a recess 12 formed therein at its upper end capable of receiving the head or knob 13 of the locking member 14 when the latter is in its locked position. Preferably a soft rubber or plastics washer 15 is provided within the recess 12 and seats on the shoulder 16 at the lower end thereof. By providing such a washer the head will sink down into the mass of rubber to ensure non-protruding fit on locking. Sound damping is also ensured.

The bottom of the body member 10 may be provided with a lip 17 (see FIGS. 2, 4, 5 and 6) so that on locking the body grips the trim to make a tight fit without a gap beneath the body. Alternatively or in addition a self-adhesive rubber washer may be provided beneath the base having a slightly larger diameter than the body at its base. The body would then grip the washer firmly when locking takes place so as to secure the body tightly.

By providing a conical surface to the body it is not possible to engage a loop of wire or metal band on the body. The body may alternatively be cylindrical on a solid of revolution of tapered form having a concave generatrix. In any construction although free from protrusions the surface may have a slightly roughened or dimpled surface sufficient to assist manual gripping by insufficient to permit purchase by a wire or metal tape.

To apply the device the user merely unscrews the locking member 14 and withdraws it from the door body, slips the body 10 and washer 15 on to the member 14 which is then screwed back into the door body to reengage the lock mechanism.

With the locking member in the locked position it is only possible to lift the locking member by gripping and raising the anti-theft device from within the vehicle in the normal way.

The recess 12 may have slightly sloping walls so as to allow easy passage for the head of the locking member as it is pressed down. The inside edge of the upper end of the recess may be radiused to ensure that the head is not impeded at the end of the downward locking stroke of the locking member.

The many different models of cars have many different lengths and thickness of locking knobs. Therefore different shapes and lengths of cone or cylinder would be made for Audi cars, for example, where the locking knob drops a long way upon locking. The recess at the top is therefore made deeper to accommodate the greater downward stroke of locking knob.

Some cars have a narrower top to the door capping, therefore this is taken into account when designing the elongate body to suit that particular car.

The use of the washer only without the lip 17 may be preferred where the capping is of a hard material or where a customer would not like the lip digging into the material thus causing damage.

Figure 5:
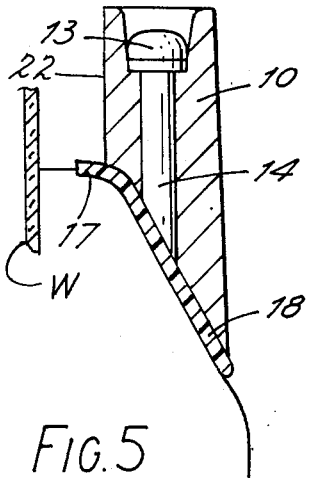
FIG. 5 is a sectional view of an alternative form of anti-theft knob device.

In the examples shown in FIG. 5 the lower surface of the body 10 is specially shaped according to the design of the vehicle. In this case the shape accommodates an inclined door capping. However, different shapes may be provided according to the shape of the capping.

The lower edge of the body 10 may have a lip 17 which engages the upper surface of a rubber washer 18 about 3 mm thick which on its other side is provided with an adhesive so that the washer once applied remains attached to the capping.

Figure 6:
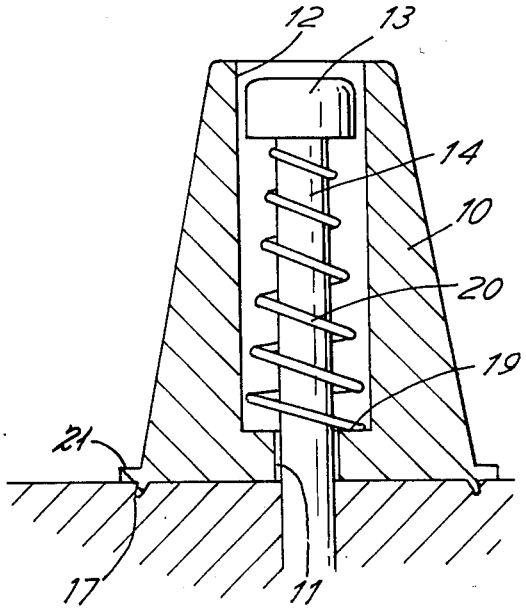
FIG. 6 is a further embodiment showing a spring which urges the body of the anti-theft device against the door capping.

In the example shown in FIG. 6 the elongate body 10 is again provided with a recess 12 to accommodate the knob 13. However, the recess extends over a major portion of the axial length of the body terminating in a shoulder 19. A coiled compression spring 20 of substantially conic form overall is provided within the recess 12. The spring maintains the lip 17 in engagement with the door capping.

By means of the provision of the spring accommodated within a relatively long recess the anti-theft device is suited to a wide range of door locks where the locking/unlocking stroke of the locking member varies from model to model.

In the above examples the exterior surface of the elongate body is free from protrusions and is of such shape that it is not possible to effect a purchase of a piece of wire or tape on the body. A cylindrical surface may suffice but more especially suitable is a frustum of a cone. Preferably the sides of the body are tapered from a larger cross-sectional area at its base to a region of smaller cross-sectional area.

Figure 7:
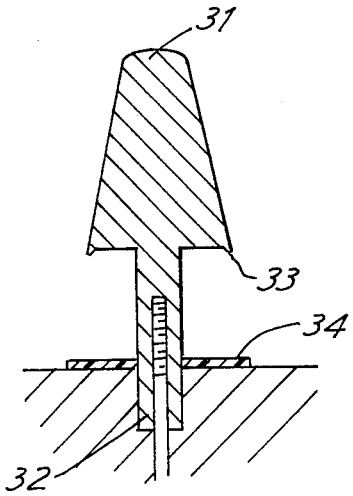
FIG. 7 is a longitudinal section through an anti-theft knob device having an inclined external surface, the device being in an unlocked position.
Figure 8:
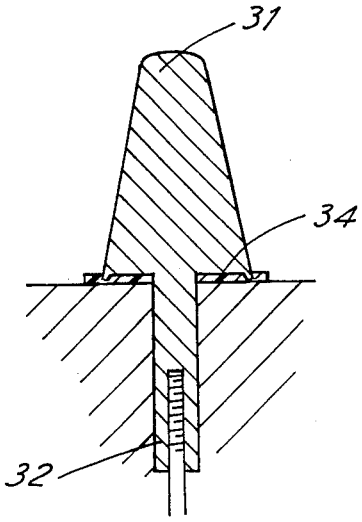
FIG. 8 shows the device of FIG. 7 in a locked position.

In a further example of an anti-theft device the elongate body 31 is attached to the stem of the locking member and replaces the old locking knob, the old knob having been unscrewed and replaced by the new device. The elongate body 31 is formed integrally with a shaft 32 which screws directly onto the screwthread on the stem of the door lock. This arrangement performs the same function as the separate cone system, except that on unlocking the door and locking the whole device would move up (FIG. 7) and down (FIG. 8).

A small lip 33 is provided on the bottom of the body 31, to ensure a tight fit when brought into a locked position with a self-adhesive rubber washer 34 which would be secured to the door capping.

The cone is of sufficient dimension to ensure that it can be lifted easily and may be made of high density plastic or light alloy.

The screw thread in the shaft 32 may engage directly into a moulded plastic device, or a metal or nylon or similar sleeve 7 having a threaded bore embedded in the shaft during moulding. Different specifications in the device (length and size and shape) may be provided to accommodate the different car models on the market, e.g. the length of travel of the locking system, and type of door capping.

In the examples of FIGS. 1, 5 and 9, a vertical flattened surface 22 may be provided on one side of the body 10 to ensure clearance between the latter and the window.

Any of the above described embodiments (see FIGS. 1, 6 and 9) may be modified by the provision of an external substantially rectilinear flange 21 extending radially to a distance of about 1 to 2 mm and about 1 to 2 mm axially, the lower surface of the flange being at the level of the lower surface of the body. In the case of the embodiment with the flattened surface the flange will be provided only on the circular peripheral portion as shown in FIG. 9.

The flange provides an additional safeguard against attempts to slide a wire down the surface of the cone and under the body to lift it up.

I claim:

1. An anti-theft device for vehicle door locks of the type having an elongated stem which is vertically reciprocally movable between an upper unlocked position and a lower locked position with respect to the door sill adjacent a vehicle window and wherein an enlarged head is carried on the upper end of the lock stem comprising, (a) an elongated body having an exterior surface portion and upper and lower ends, said lower end of said body being engageable with the door sill, (b) a bore extending through said body from said upper to said lower end thereof, said bore being of a size to receive the stem of the door lock therethrough, (c) said bore having a recess extending into said body from said upper end and toward said lower end thereof, said recess being of a size to receive the head of the door lock therein, (d) a shoulder formed between said bore and said recess, (e) a resilient means disposed within said recess and having a lower end seated with said shoulder and an upper end extending toward said upper end of said body, said upper end of said resilient means being engageable by the head of the door lock when said body is mounted in encircling relationship about the stem of the door lock, said resilient means continuously urging said body toward the door sill when the head of the door lock is positioned within said recess.

2. The anti-theft device of claim 1 in which said body includes a flange portion extending radially outwardly from said lower end thereof so as to be in abutting contact with the door sill when said body is placed about the stem of the door lock.

3. The anti-theft device of claim 1, wherein said exterior surface portion of said body is in the shape of a frustum of a cone.

4. The anti-theft device of claim 1, wherein said exterior surface portion of said body is in the shape of a frustum of a cone having a portion thereof formed as a flattened surface.

5. The anti-theft device of claim 4 including a radial flange extending outwardly from said lower end of said body along the conical portions thereof.

6. The anti-theft device of claim 1, wherein said body includes a lip depending from said lower end thereof, said lip gripping the door sill when said door lock is in a locked position.

7. The anti-theft device of claim 6 including a deformable washer means, said washer means being positioned intermediate said lip and the door sill so that on movement of the door lock to a locked position said lip deforms the washer means to ensure that said body is tightly secured.

8. The anti-theft device of claim 1 wherein said lower end of said body is inclined so as to cooperatively engage an inclined door sill.

9. The anti-theft device of claim 1 wherein said resilient means is a coiled spring.

10. An anti-theft device for vehicle door locks of the type having an elongated stem which is vertically reciprocally movable between an upper unlocked position and a lower locked position with respect to the door sill adjacent a vehicle window and wherein an enlarged head is carried on the upper end of the lock stem comprising, (a) an elongated body having a continuous side exterior surface portion and upper and lower ends, said lower end of said body being engageable with the door sill, said exterior surface portion of said body being substantially in the shape of a frustum of a cone, (b) a bore extending through said body from said upper to said lower end thereof, said bore being of a size to receive the stem of the door lock therethrough, (c) said bore having a recess extending into said body from said upper end and substantially toward said lower end thereof, said recess being of a size to completely receive the head of the door lock therein, (d) a shoulder formed between said bore and said recess and adjacent said lower end of said body, (e) a resilient means disposed within said recess and having a lower end seated with said shoulder and an upper end extending toward said upper end of said body, said upper end of said resilient means being engageable by the head of the door lock when said body is mounted in encircling relationship about the stem of the door lock, said resilient means continuously urging said body toward the door sill when the head of the door lock is positioned within said recess, and (f) said body including a flange portion extending radially outwardly from said lower end thereof so as to be in abutting contact with the door sill when said body is placed about the stem of the door lock.

11. The anti-theft device of claim 1, wherein said body includes a lip depending from said lower end thereof, said lip gripping the door sill when said door lock is in a locked position.

* * * * *